US005613557A

United States Patent [19]

Blount et al.

[11] Patent Number: 5,613,557

[45] Date of Patent: Mar. 25, 1997

[54] APPARATUS AND METHOD FOR SEALING PERFORATED WELL CASING

[75] Inventors: Curtis G. Blount, Wasilla, Ak.; Robert A. Benham, Albuquerque, N.M.; Jerry L. Brock, Los Lunas, N.M.; John A. Emerson, Albuquerque, N.M.; Keith R. Ferguson, Anchorage, Ak.; Donald F. Scheve, Anchorage, Ak.; Joseph H. Schmidt, Anchorage, Ak.; Karl W. Schuler; Philip L. Stanton, both of Albuquerque, N.M.

[73] Assignee: Atlantic Richfield Company, Los Angeles, Calif.

[21] Appl. No.: 448,108

[22] Filed: May 23, 1995

Related U.S. Application Data

[63] Continuation-in-part of Ser. No. 282,685, Jul. 29, 1994, Pat. No. 5,456,319.

[51] Int. Cl.[6] ..... E21B 29/10

[52] U.S. Cl. ..... 166/277; 166/286; 166/299; 166/373; 166/63

[58] Field of Search ..... 166/277, 296, 166/373, 374, 381, 286, 387, 63, 153, 181, 192, 299

[56] References Cited

U.S. PATENT DOCUMENTS

| | | | |
|---|---|---|---|
| 2,214,227 | 9/1940 | English | 166/299 |
| 3,167,122 | 1/1965 | Lang | 166/299 X |
| 3,191,677 | 6/1965 | Kinley | 166/299 X |
| 4,662,450 | 5/1987 | Haugen | 166/299 |
| 4,972,906 | 11/1990 | McDaniel . | |
| 5,456,319 | 10/1995 | Schmidt et al. | 166/373 |

*Primary Examiner*—William P. Neuder
*Attorney, Agent, or Firm*—Michael E. Martin

[57] ABSTRACT

Perforations and other openings in well casings, liners and other conduits may be substantially blocked or sealed to prevent fluid flow between the casing or liner interior and an earth formation by placing a radially expansible sleeve adjacent the perforations or openings and urging the sleeve into forcible engagement with the casing or inner wall using an explosive charge. An apparatus including a radially contracted sleeve formed by a coiled plate member or a tubular member having flutes defined by external and internal folds, may be deployed into a well casing or liner through a production or injection tubing string and on the end of a flexible cable or coilable tubing. An explosive charge disposed on the apparatus and within the sleeve may be detonated to urge the sleeve into forcible engagement with the casing inner wall.

23 Claims, 5 Drawing Sheets

APPARATUS AND METHOD FOR SEALING PERFORATED WELL CASING

STATEMENT AS TO RIGHTS TO INVENTION MADE UNDER FEDERALLY SPONSORED RESEARCH AND DEVELOPMENT

This invention was made in part with United States Government support under Contract No. DE-AC04-94AL85000 awarded by the U.S. Department of Energy. The Government has certain rights in this invention.

CROSS REFERENCE TO RELATED APPLICATION

This application is a continuation-in-part of copending application Ser. No. 08/282,685, filed Jul. 29, 1994, U.S. Pat. No. 5,456,319.

FIELD OF THE INVENTION

The present invention pertains to apparatus and methods for explosive or high energy deployment of a perforation or fracture blocking sleeve within a well tubing or casing.

BACKGROUND OF THE INVENTION

In many fluid production or injection well installations, fluid communication between the well and the earth formation penetrated by the well is carried out through perforations or other openings in a well casing or liner. In some instances, a well casing or liner may become split or otherwise damaged to place the well in fluid flow communication with the earth formation in an area where such communication is not desired. Other well conduits or production fluid tubing, for example, may also suffer unwanted damage which can cause fluid leakage.

Closing off casing perforations or sealing a fractured or otherwise damaged casing can be time consuming and expensive, particularly for wells in which other structural members such as production tubing strings and the like have been installed. The presence of a fluid production tubing string, for example, prevents the deployment of a sleeve or liner that is larger in diameter than the tubing string without first removing the tubing string from the well. In this regard, certain methods and apparatus have been contemplated for installing a sleeve in a well to at least substantially seal casing perforations without removing smaller diameter structures such as tubing strings from the well. Although the apparatus and methods described in the above-referenced patent application, for example, provide one means for effectively blocking well perforations there are certain well installations wherein differential pressures may exist between the formation and the wellbore which require a tighter seal than may be provided by an elastically expandable sleeve.

Another problem associated with conventional casing or tubing patching techniques is that conventional patching requires the use of spaced apart packers and a bridging section of tubing or casing to block the fracture or other source of unwanted leakage. This structure substantially reduces the useful diameter of the wellbore through which fluid is required to flow and through which various types of wellbore tools are desired to be inserted. Accordingly, a desirable casing or other well conduit patching device should reduce the inside diameter of the patched casing or conduit as little as possible.

It is to these ends that the present invention has been developed with a view to providing effective means and methods for sealing well casing perforations and other openings in casings or well conduits which are desired to be blocked to prevent fluid flow between a wellbore and an adjoining earth formation interval, or to prevent other unwanted flow to or from a well conduit.

SUMMARY OF THE INVENTION

The present invention provides unique apparatus and methods for sealing or blocking perforations or other openings in well casings, liners or other well conduits to substantially prevent fluid communication between a well and an adjoining earth formation zone or interval or otherwise prevent fluid flow through such perforations or openings.

In accordance with one important aspect of the present invention, apparatus is provided for sealing well casing perforations or other openings in casing or other well conduits by high energy explosive deployment of a sleeve-like member into engagement with the inner wall of the casing or conduit to effectively block such perforations or other openings.

One important advantage of the invention is that, once the sleeve-like member is expanded and plastically deformed into the perforations or other openings in the casing or conduit, the inner diameter of the casing or conduit is decreased by only a small amount. In this way, fluid flow is not impeded and various tools and devices may be extended through the casing or conduit without interference.

Preferred embodiments of apparatus are provided which may be inserted into a well through a tubing string or other structure and then placed adjacent to the casing or other conduit in the vicinity of the perforations or other opening to be blocked. The apparatus is operable to detonate an explosive charge to deploy an expandable sleeve-like member into forcible engagement with the casing inner wall to block one or more perforations or other openings which may be formed in the casing. One embodiment provides for radial expansion of a coiled sleeve under urging of the sleeve elastic memory followed by explosive deployment of the sleeve into forcible engagement with the casing or conduit wall.

Still further, preferred embodiments of the apparatus include expandable, seamless or coiled sleeve members or a fluted sleeve member, all of which are radially expansible under the urging of a high energy source such as an explosive or high pressure gas generating composition. These embodiments may be deployed in wellbores wherein liquids in the vicinity of deployment of the sleeve have been evacuated to minimize absorption of the explosive energy during deployment of the sleeve. Alternatively, one or more of the above-mentioned sleeve embodiments may be expanded into close proximity to or at least moderate contact with the casing or conduit wall followed by the explosive deformation step.

The radial outward expansion of the sleeve member may provide for some plastic deformation of the member into the perforation or other opening in the casing to form a fluid tight seal which will withstand a substantial pressure differential across the opening so that the sleeve member remains in place under substantially all conditions of operation to which the well may be exposed.

Moreover, the sleeve member may be provided with a suitable coating on one or both sides, such as a soft metal, an adhesive, or a thermite material to assist in holding the sleeve member in place in forcible engagement with the casing and to minimize fluid leakage around or through the sleeve member. The coiled sleeve member may have cooperating projections and recesses formed on a portion thereof to assist in locking the sleeve member in place in engagement with the casing.

In accordance with another important aspect of the invention, there is provided a method for sealing wellbore casings, liner members and similar conduits to close off previously formed perforations or other unwanted openings by deployment of a sleeve or plate member which is acted on by a high energy source such as an explosive or similar high pressure gas generating composition to effect radial expansion of the sleeve or plate and to subject the sleeve or plate to some plastic deformation to insure a substantially fluid-tight engagement of the sleeve or plate with the casing or conduit.

Embodiments of the apparatus and method are provided wherein a perforation blocking sleeve or plate may be deployed into the well through a tubing string or other structure which is of substantially smaller diameter than the inner wall of the casing or other conduit to be sealed. One embodiment of the invention is operable to expand a seamless sleeve into engagement with a casing or conduit in installations wherein the apparatus and sleeve are of only slightly smaller diameter than the inner wall of the casing.

Those skilled in the art will further appreciate the above-mentioned features and advantages of the invention together with other superior aspects thereof upon reading the detailed description which follows in conjunction with the drawings.

BRIEF DESCRIPTION 0F THE DRAWING

DESCRIPTION OF PREFERRED EMBODIMENTS

Figure 1:
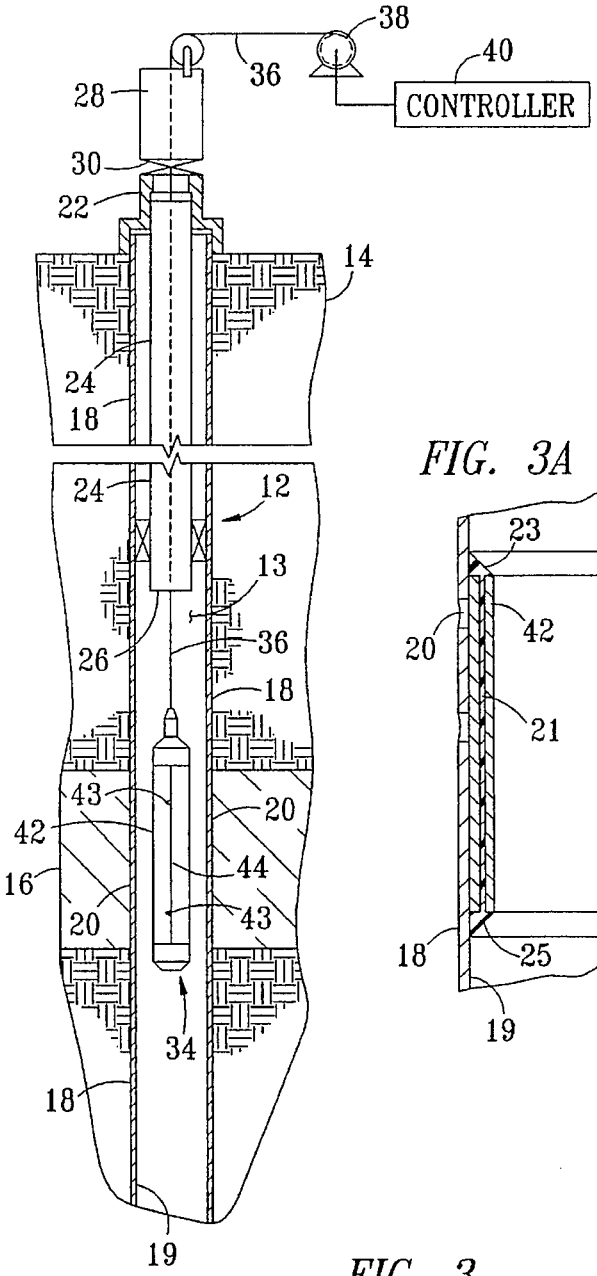
FIG. 1 is a vertical section view of a cased well prepared to have a set of casing perforations blocked or sealed by an apparatus and method of the present invention.

In the description which follows, like elements are marked throughout the specification and drawing with the same reference numerals, respectively. The drawing figures are not necessarily to scale and certain features may be shown in somewhat schematic or generalized form in the interest of clarity and conciseness.

Referring to FIG. 1, there is shown a conventional cased fluid production well 12 extending within an earth formation 14 including a zone 16 from which fluids have been produced during previous operation of the well. The well 12 includes an elongated casing or liner 18 extending through the formation zone 16 and perforated at multiple perforations 20 through which fluids have been produced from the zone 16. The casing 18 may, as shown, extend to a surface wellhead 22 of conventional design and from which hangs a production tubing string 24 extending within the well 12 to a lower distal end 26. The casing 18 may also be connected to a suitable hanger, not shown, disposed intermediate the wellhead 22. The wellhead 22 is also fitted with a conventional wireline lubricator 28 including a conventional lubricator valve 30.

The zone 16 may, for example, have been depleted of useful production fluids and be producing unwanted water or gas into the wellbore 13. Accordingly, it may be desirable to block some or all of the perforations 20 to prevent fluids from flowing between the formation zone 16 and the wellbore 13. Various methods have been developed in the prior art for blocking the perforations 20 including forming temporary cement plugs which are then drilled out sufficiently to restore the wellbore 13, or bridging the area where the perforations exist by a relatively complicated tubing and packer structure. It is desirable to be able to seal the perforations 20 as simply as possible without providing additional complicated structure or carrying out wellbore operations which may result in having to inject cement mixtures or the like into the well. In this regard, unique apparatus and methods have been developed in accordance with the above-referenced patent application for deploying a coilable sleeve into a position which permits the sleeve to expand to engage the well casing 18 at its inner wall surface 19 to block the perforations 20.

However, in most applications, the elastic spring force of the coiled sleeve may not be sufficient to effectively seal the perforations 20 or to prevent unwanted displacement of the sleeve due to high differential pressure between the wellbore space 13 and the formation zone 16. In this regard, the present invention contemplates the placement of a perforation or other casing opening blocking and sealing member which may comprise a coiled sleeve similar to that described in the above-mentioned application. Moreover, deployment of the aforementioned sleeve in accordance with the present invention forms a substantially fluid tight seal at some or all of the perforations 20 and retains the sleeve in its desired position more effectively.

FIG. 1 shows a unique apparatus 34 deployed in the wellbore 13 through the tubing string 24. The apparatus 34 is connected to suitable deployment means comprising an elongated flexible cable 36 which may comprise suitable electrical conductors disposed within the hollow core of a braided or wound wire rope structural cable member, sometimes known as an electric or E-line. The cable 36 is operable to be reeled into and out of the wellbore 13 by a conventional cable drum 38 and electrical signals may be transmitted to and through the cable in a manner known to those skilled in the art from a suitable controller 40 for a purpose to be described herein. The cable 36 is extensible through the wireline lubricator 28 in a conventional manner.

Alternatively, coilable tubing having suitable electrical conductors disposed therein may be used to deploy the apparatus 34 into the well. The apparatus 34 may include suitable devices for automatic energization of the apparatus based on the pressure in the wellbore, or responsive to other sensors which would identify the position of the apparatus within the well including a gamma ray sensor or a device to count casing collars or other position identifying devices disposed along the casing or conduit through which the apparatus 34 is being conveyed.

Figure 2:
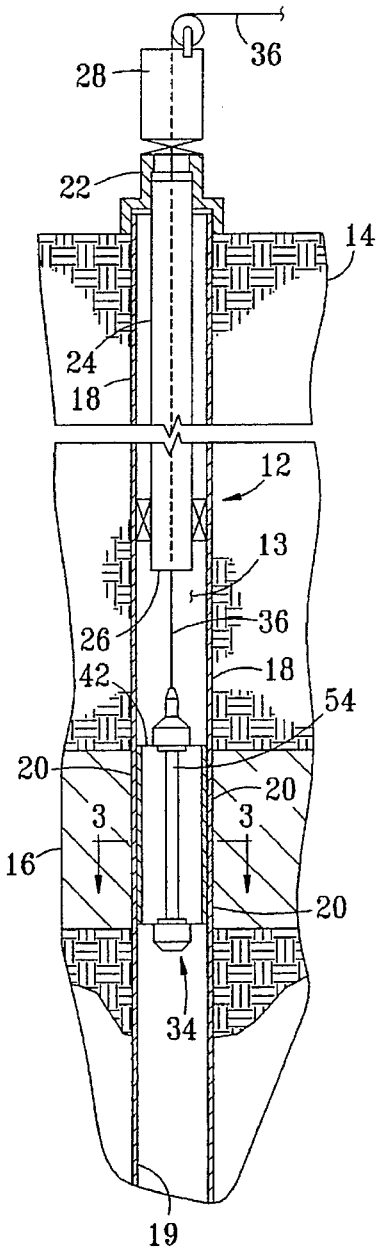
FIG. 2 is a view of the well of FIG. 1 after deployment of a perforation blocking sleeve.

The apparatus 34 supports a coiled perforation blocking sleeve 42 thereon which may be radially deployed into engagement with the casing inner wall 19 to effectively block or seal the perforations 20 from communicating fluid between the wellbore 13 and the formation zone 16. FIG. 2 illustrates the sleeve 42 in its deployed position blocking the perforations 20. The sleeve 42 may be formed of relatively thin metal plate which is wrapped or coiled into multiple layers so that it may be reduced in diameter and secured on the apparatus 34 for movement into the wellbore 13 through the tubing string 24. Accordingly, the maximum diameter of the apparatus 34 is slightly less than the inside diameter of the tubing 24. The apparatus 34 may be deployed into the wellbore 13 through the lubricator 28, valve 30 and tubing string 24 in a manner similar to that used for deploying many types of wellbore devices.

The sleeve 42 may be elastically coiled into the position shown in FIG. 1 so that it has a tendency to uncoil and expand radially outward due to its own elastic memory. The sleeve 42 may be held in its coiled position by suitable means including one or more tack welds 43 along a transverse edge 44. The sleeve 42 may also be retained in its coiled condition by a weak adhesive between the sleeve layers or wraps. Alternate means for retaining the sleeve 42 in its coiled condition are described below in conjunction with FIG. 4 of the drawing. The sleeve 42 may also be plastically coiled into the position illustrated in FIG. 1 and then plastically deformed into forcible engagement with the inner wall 19 of the casing 18 as part of a high energy explosive forming operation carried out by the apparatus 34. Alternatively, if the wellbore cannot be evacuated of liquid in the vicinity of deployment of the sleeve 42, the sleeve may be deployed into engagement with the casing wall 19 by pumping fluid into a distendable bladder, not shown in FIG. 1, positioned inside the apparatus 34 to expand the sleeve into engagement with the casing inner wall 19. Other means of mechanically expanding the sleeve 42 to engage the casing inner wall 19 may also be employed by those skilled in the art.

Figure 3A:
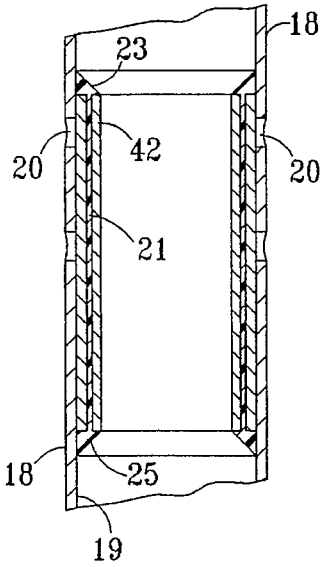
FIG. 3A is a detail view showing a sleeve in a deployed position which has sealant material present on the sleeve.
Figure 3:
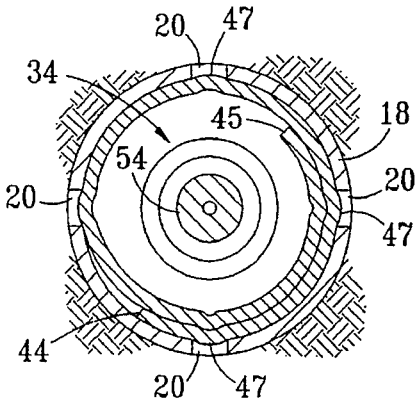
FIG. 3 is a section view taken from the line 3—3 of FIG. 2.

FIG. 3 illustrates the deployed working position of the sleeve 42 covering all of the perforations 20. The sleeve 42 is of sufficient width such that, in the uncoiled condition illustrated in FIG. 3, opposite side edges 44 and 45 of the sleeve overlap, as shown, and the forcible deployment of the sleeve into engagement with the casing 18 may result in some plastic deformation of the sleeve into the perforations 20 such as indicated at 47. In this way, a substantially fluid tight seal is formed between the sleeve 42 and the casing 18 along edges which define the perforations 20. The sleeve 42 may also, in its deployed position, still have multiple layers or wraps of material.

Additionally, a sealant may be applied to the surfaces of the sleeve 42 as well as along its longitudinal and transverse side edges prior to wrapping the sleeve into its coiled condition on the apparatus 34. FIG. 3A illustrates a sleeve 42 in its deployed position in forcible engagement with the wall 19 of casing 18 and wherein multiple layers or wraps of the sleeve are formed in the deployed position and further wherein a layer of sealant 21 has been applied at least between the layers or wraps of the sleeve 42. In the deployed position, some sealant 21 has been squeezed out of the sleeve 42 at opposite ends to form somewhat beveled layers of sealant 23 and 25, as shown. The layers of sealant 23 and 25 seal the ends of the sleeve 42 to prevent fluid leakage therealong and between the casing wall 19 and the sleeve. Moreover, the layers of sealant 23 and 25 also provide a continuous surface along the casing wall 18 to minimize the chance of interference of the movement of wellbore tools and devices through the casing 19. The sealant 21 may be selected from any one of a group consisting of polysulfides, fluorosilicones, polyphosphazenes and combinations thereof. The term sealant as used herein is distinct from the term adhesive. The use of the term adhesive is in the context of a material that is capable of forming a bond between the parts to be secured to each other whereas, the term sealant is used in the context of providing a substantially fluid tight seal to prevent unwanted fluid flow.

Figure 4:
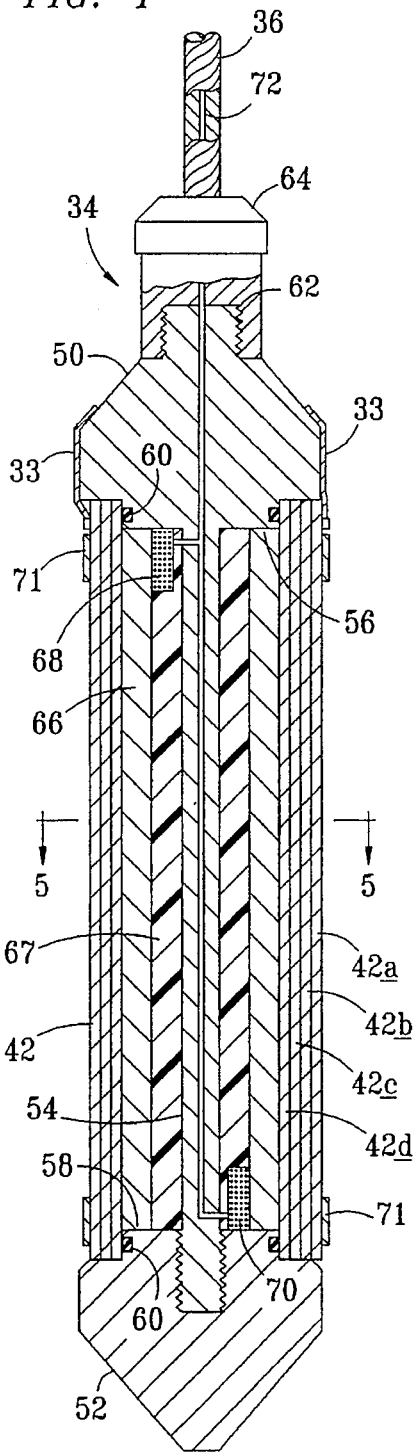
FIG. 4 is a section view of one preferred embodiment of an apparatus for deploying a perforation blocking and sealing sleeve in accordance with the invention.
Figure 5:
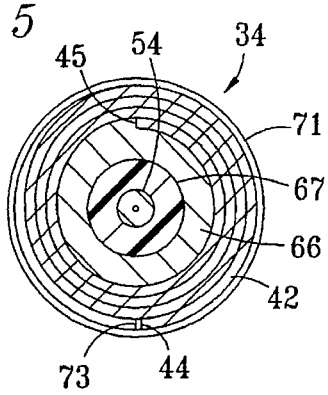
FIG. 5 is a transverse section view taken from the line 5—5 of FIG. 4.

Referring now to FIGS. 4 and 5, the apparatus 34 is illustrated in some detail and is characterized by opposed upper and lower head members 50 and 52 which are interconnected by a center column member 54. The column member 54 may be threadedly connected to one or the other of the head members 50 and 52. The head members 50 and 52 preferably have opposed reduced diameter flanges 56 and 58, each having a circumferential elastomeric seal ring 60 disposed thereon and engageable with an inner wrap of the coiled sleeve 42, as illustrated. The upper head member 50 has a suitable axial projecting threaded portion 62 which is operable to be connected to a conventional cable socket 64 for connecting the apparatus 34 to the cable 36.

FIG. 4 also illustrates a suitable quantity of explosive or high pressure gas generating charge material 66 formed as an annular ring disposed between the flanges 56 and 58. The material 66 may be a conventional explosive material of a type used in so-called explosive forming or shape modification of metals. Accordingly, the material 66 may be of either the detonating or deflagrating type. The explosive material 66 may be operable to be energized by spaced apart igniter devices 68 and 70 which are suitably connected to electrical conductor means 72 extending within the column member 54 and the cable 36. Accordingly, the charge material 66 may be energized from the controller 40, at will, to effect displacement of the sleeve 42 into forcible engagement with the casing 18 as described above. As shown in FIG. 4, the sleeve 42 may actually require several overlapping wraps or layers 42*a*, 42*b*, 42*c* and 42*d*, in the radially contracted condition shown, in order for there to be sufficient circumferential length of the sleeve in the deployed position, including some overlap of the edges 44 and 45, to assure that a seal can be formed to substantially prevent fluid flow between the wellbore 13 and the formation zone 16 by way of the perforations 20.

FIGS. 4 and 5 also illustrate a modification to the apparatus 34 wherein plural relatively thin bands or straps 71 are disposed around the sleeve 42 to hold the sleeve disposed on the apparatus in a coiled condition. Each of the bands 71 may be suitably provided with an explosive charge 73, as shown by example in FIG. 5, suitably connected to conductor means, not shown, operably in communication with the cable 36, to cause the bands to break, at will, to allow the sleeve 42 to deploy into forcible engagement with the casing or conduit wall 19. Still further, the sleeve 42 may be secured against falling out of position through the wellbore 13 by plural flexible cables 33 secured to the head member 50 and to the sleeve 42 at spaced apart points, as indicated in FIG. 4. The cables 33 are of sufficient length to allow the sleeve 42 to deploy into engagement with the casing wall 19 and, upon igniting the explosive charge 66, the cables may be severed from the sleeve to allow withdrawal of the apparatus 34 from the wellbore 13.

Figure 5A:
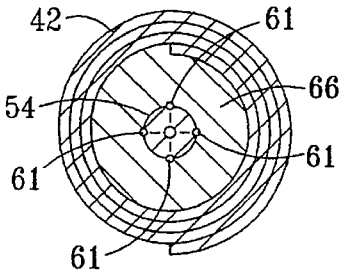
FIG. 5A is a transverse section view similar to FIG. 5 illustrating an embodiment of the invention having strands of fuse as the main explosive charge.

Referring now to FIG. 5A, an alternate arrangement of explosive material is illustrated wherein plural strands of commercially available detonator material are provided and generally designated by the numeral 61. The strands 61 may be formed of a material commercially known as Mild Detonating Fuse. The detonator strands 61 are disposed in suitable longitudinal grooves formed in the column member 54 and substantially coextensive therewith. The explosive charge may be provided by a sufficient number of the strands 61 or the strands may be augmented by charge material 66 disposed between the head members 50 and 52.

Accordingly, the apparatus 34 may be deployed in the well 12 through the tubing string 24, as previously described, and positioned adjacent a portion of the casing 18 which is desired to be sealed to prevent communication between the wellbore and an earth formation interval. Once the apparatus 34 has been deployed in its desired position, the band 71 or tack welds 43, or other means of retaining the sleeve 42 in its coiled condition are broken by ignition of a suitable detonating fuse, not shown, such as a strip of Mild Detonating Fuse, or other severing means known to those skilled in the art. The sleeve 42 is then capable of expanding by its own elastic memory or of being forced outward toward the casing wall 19 by other means discussed herein. The aforementioned igniters are then initiated to plastically deform the sleeve 42 into the perforations 20. So-called latching mechanisms, constructed of mechanical features or chemical adhesives, as described hereinbelow, may be employed to lock the sleeve 42 in place against the casing wall 19, thus effecting a fluid tight seal between the sleeve and the casing 18. The working position of the sleeve 42 is illustrated in FIG. 3, wherein the sleeve is plastically deformed with sufficient force to provide for firm engagement of the sleeve with the casing to effectively seal the perforations 20. Thanks to the configuration of the sleeve 42 it may be wrapped in the manner described above to provide a small enough diameter that the sleeve may be deployed into the well through a tubing string which is considerably smaller in diameter than the casing or liner to be sealed.

As shown in FIG. 4, an elongated sleeve of suitable buffer material 67 may be disposed between the charge material 66 and the column member 54. This buffer material 67 may be a suitable inert thixotropic material for distributing the charge energy and pressure substantially evenly circumferentially around the column member 54 to provide for uniform radial outward expansion of the sleeve 42. Alternatively, the inner space occupied by the buffer material 67 may be occupied by the charge material 66 and a sleeve of buffer material provided between the charge material and the expansible sleeve 42 to assist in uniform distribution of the radial expansion forces exerted on the sleeve 42.

Figure 6:
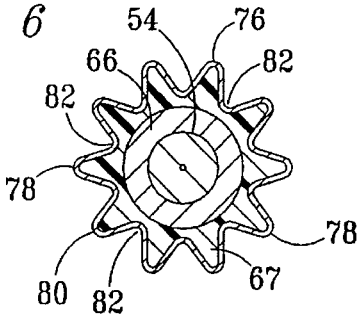
FIG. 6 is a transverse section view similar to FIG. 5 showing a first alternate embodiment of a perforation blocking and sealing sleeve.
Figure 7:
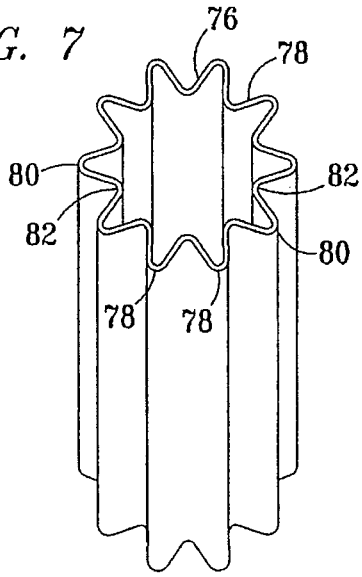
FIG. 7 is a perspective view of the embodiment of the sleeve illustrated in FIG. 6.

Referring now to FIGS. 6 and 7, there is illustrated a modification to the apparatus 34 wherein a radially expansible sleeve member 76 is disposed around the column member 54 in place of the sleeve 42. The sleeve 76 is preferably an elongated seamless or closed seam tubular member having plural radially projecting flutes 78 formed by circumferentially spaced external and internal folds 80 and 82, respectively. The sleeve 76 may also be formed of multiple layers of this metal, initially coiled, then die formed to provide the folds 80 and 82. In the embodiment shown in FIG. 6, the explosive charge material 66 is disposed between the center column member 54 and the buffer material 67, as illustrated. Accordingly, the sleeve 76 may be radially expanded into a substantially circular configuration in forcible engagement with the inner wall 19 of the casing 18 in place of the sleeve 42. Alternatively, the sleeve 76 may be initially expanded into engagement with the casing wall 19 by suitable means such as applying fluid pressure forces thereto. An alternate embodiment of the invention having such a feature is described below in conjunction with FIG. 15. The configuration of the sleeve 76, in the undeployed position, as provided by the folds 80 and 82, enables the sleeve to also be of a small diameter sufficient to permit deployment of the sleeve 76 on the apparatus 34 into the well through a tubing string such as the tubing string 24. In fact, the sleeves 42 and 76 may be expanded from their coiled and folded conditions to a substantially cylindrical diameter at least twice their maximum diameters in their coiled and folded positions, respectively.

Figure 8:
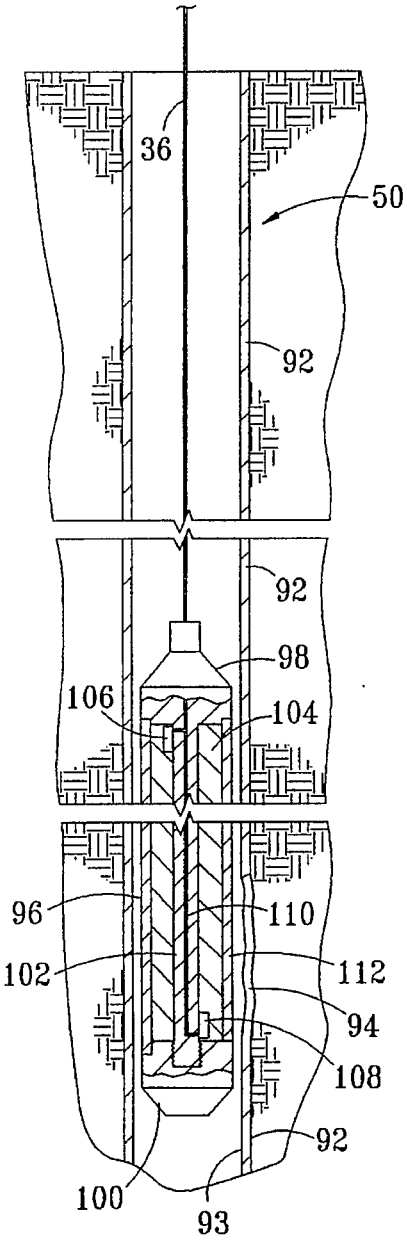
FIG. 8 is a longitudinal section view of a well casing and a first alternate embodiment of an apparatus in accordance with the invention.
Figure 9:
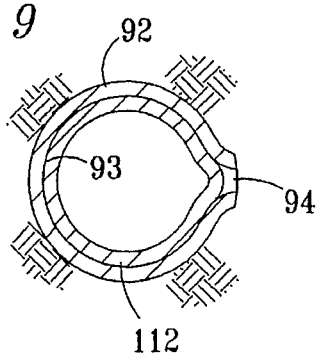
FIG. 9 is a transverse section view showing a sleeve deployed to block a rupture in the casing illustrated in FIG. 8.

Referring now to FIGS. 8 and 9, in certain situations a well or other underground passage, for example, may have a casing, liner or other conduit which has ruptured or failed wherein a cylindrical tubular sleeve may be inserted in the conduit and radially expanded into engagement with the conduit inner wall in substantially fluid tight sealing relationship thereto. However, the sleeve does not require to be substantially radially expansible in the manner of the sleeves 42 or 76 but only in respect to being plastically deformed to a slightly larger diameter. FIG. 8 shows, for example, a well 90 having a conduit or casing 92 disposed therein which has an unwanted rupture or opening 94 formed in the wall thereof. An apparatus 96 in accordance with the invention is shown disposed in the casing or conduit 92 adjacent the opening 94 and suspended within the well by a cable 36 as described hereinabove. The cable 36 is adapted to be connected to the controller 40 by way of a cable drum 38, neither of which is shown in FIG. 8. The apparatus 96 includes opposed head members 98 and 100 interconnected by center column member 102.

One or more strands of the above-mentioned Mild Detonating Fuse explosive detonator material may be disposed on the apparatus 96 between the head members 98 and 100 and along or near the center column member 102 as a preferred means of initiating a charge to plastically deform a tubular sleeve 112 into forcible engagement with the casing 92. An alternate method of initiating forcible deployment of the sleeve 112 is by use of a quantity of explosive charge material 104 in place of or in addition to the strands of Mild Detonating Fuse material disposed on the apparatus 96 between the head members 98 and 100 and around the column member 102. Spaced apart electrically energizable igniters 106 and 108 may be provided and operably connected to conductor means 110 in the column member 102 and connected to conductor means 72 within the cable 36.

The metal tubular sleeve 112 is disposed between the head members 98 and 100 and journalling the charge material 104. The sleeve 112 is a cylindrical tube, preferably seamless, which is operable to be plastically, radially expanded, in response to ignition of the charge material 104, into substantially fluid tight sealing engagement with the inner wall 93 of the conduit or casing 92 to seal the opening 94. FIG. 9 illustrates the sleeve 112 in its deployed position with the apparatus 96 removed from the interior of the casing 92. The sleeves 76 and 112 may also be single or multiple layers of relatively thin alloy steel, for example. Alternatively, of course, as previously described, the sleeve may be formed by a continuous wrapped coil of relatively thin steel sheet.

Figure 10:
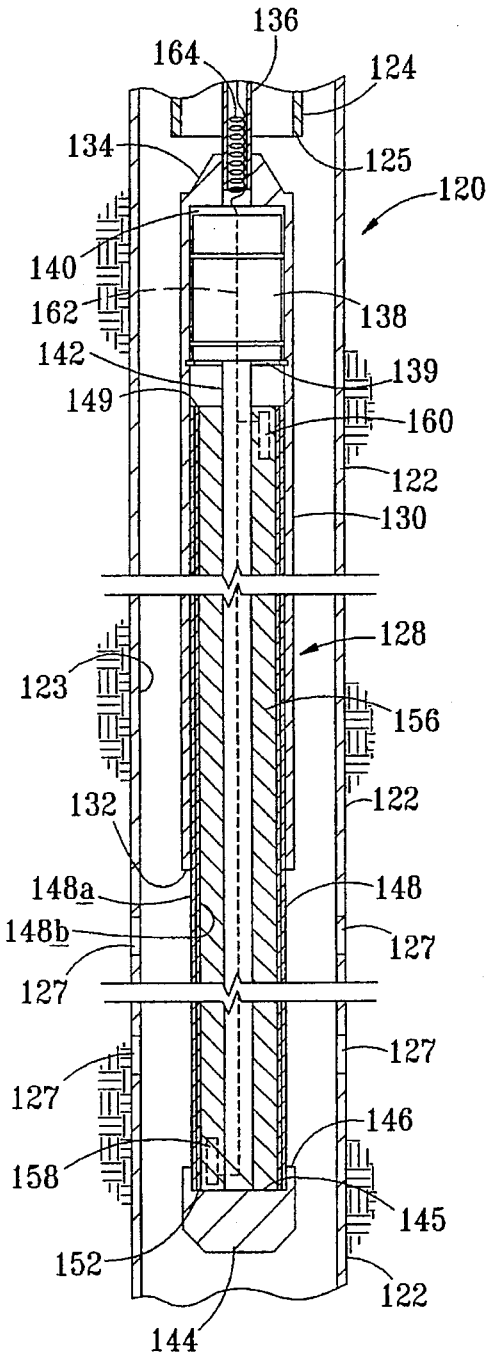
FIG. 10 is a longitudinal central section view of a second alternate embodiment of an apparatus in accordance with the invention.

Referring now to FIG. 10, there is illustrated yet another embodiment of the invention wherein a well 120 has an elongated cylindrical pipe or casing 122 disposed therein and extending below a tubing string 124 having a diameter smaller than the diameter of the casing. An apparatus similar to one of the embodiments described in U.S. patent application Ser. No. 08/282,685 is shown in FIG. 10 and generally designated by the numeral 128. The apparatus 128 includes an elongated cylinder 130 which is open at its lower distal end 132 and has a closure head 134 disposed at its opposite end. The head 134 is suitably connected to an elongated tube 136 which may comprise coilable tubing of the type used in well operations and adapted to be connected to a source of pressure fluid, not shown, at the earth's surface. A piston 138 is slidably disposed in the cylinder 130 and defines a chamber 140 in the cylinder between the piston 138 and the head 134. The piston 138 is connected to an elongated rod 142 which is connected to a lower head member 144 having an upwardly projecting circumferential flange portion 146 formed integral therewith, as illustrated.

An elongated, radially expansible sleeve 148, formed of multiple coils or wraps 148*a*, 148*b* in the position shown in FIG. 10, is disposed in the cylinder 130 and contained in the coiled condition at its lower distal end 152 by the flange 146. The sleeve 148 is shorter than the distance between the lower transverse face 139 of the piston 138 and a transverse face 145 of the head 144. The sleeve 148 is formed of an elastically expandable metal sheet wrapped into a coiled condition to form the wraps 148*a*, etc., for disposition within the cylinder 130, as illustrated. A quantity of explosive charge material 156 is disposed around the rod 142 between the sleeve 148 and the rod and is provided with one or more spaced apart electrical igniter devices 158 and 160. The igniter devices 158 and 160 are connected to suitable electrical conductor means 162 extending within the rod 142 through the piston 138 and is configured with suitable slack takeup coils 164 to be extensive within the tubing 136. The conductor means 162 also extends within the tubing 136 to the surface and may be suitably connected to a controller 40, not shown in FIG. 10, in the same manner as the embodiments of FIGS. 1 and 8. The igniter devices 158 and 160 may also be activated by suitable means engageable by the piston 138 as it reaches a limit position upon deployment of the sleeve 148.

In the operation of the apparatus 128, it may be deployed into a desired position within the casing 122 through the tubing 124 and connected to the tubing 136. Once the tubing 136 has been extended into the well, such that the apparatus 128 is disposed beyond the distal end 125 of the tubing 124 and the sleeve 148 is placed adjacent to a portion of the casing to be sealed, pressure fluid may be conducted through the tubing 136 to force the piston 138 to traverse the cylinder 130 toward the distal end 132. Initial movement of the piston 138 will result in the flange 146 moving away from the distal end 152 of the coiled sleeve 148 to allow the end of the sleeve to radially expand, thanks to the elastic memory of the coils or wraps 148*a* and 148*b*. As the piston 138 moves downward, viewing FIG. 10, it will engage the upper end face 149 of the sleeve 148 to push the sleeve out of the cylinder 130 and allow it to radially expand into engagement with the inner wall 123 of the casing 122. The movement of the piston 138 is limited due to a re-entrant edge, not shown, on the distal end 132 of the cylinder 130. The charge material 156 may have a suitable seal material provided thereover to minimize or prevent degradation due to exposure to wellbore fluids.

With the sleeve 148 deployed into engagement with the casing 122, the explosive charge 156 may be detonated to provide a suitable shock wave to forcibly deform the sleeve 148 against the casing 122 and to provide some plastic displacement of the sleeve 148 into the perforations 127 whereby a substantially fluid-tight seal is formed. The charge material 156 is provided with sufficient energy, upon detonation, to effect deformation of the sleeve 148 as described above, but having energy less than would be destructive to the casing itself. Compression of fluid in the interior of the casing 122 over several hundred or thousand feet may be sufficient to absorb the energy of the explosive charge travelling longitudinally within the casing. Accordingly, with the embodiment illustrated in FIG. 10 and described above, the sleeve 148 may be substantially placed in its working position before the explosive high energy forming process is initiated.

Figure 11:
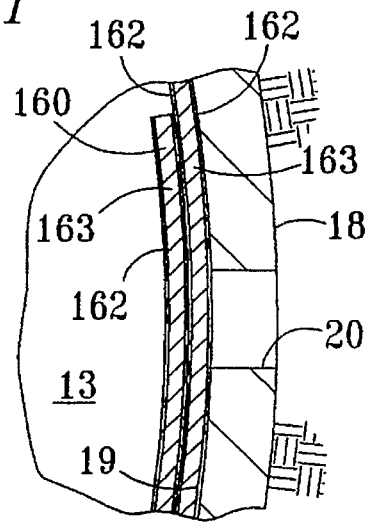
FIG. 11 is a detail transverse section showing a portion of a second alternate embodiment of a sleeve in accordance with the invention.
Figure 12:
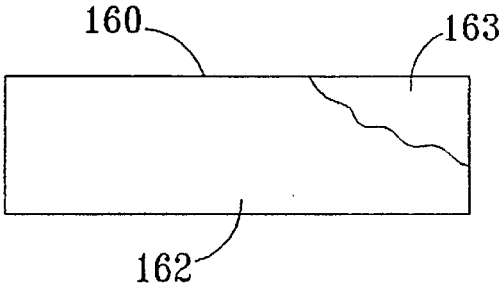
FIG. 12 is an uncoiled plan view of the sleeve shown in FIG. 11.

Referring now to FIG. 11, there is illustrated a fragmentary transverse section view of the casing 18 showing a second alternate embodiment of a coilable type sleeve in accordance with the invention and generally designated by the numeral 160. The sleeve 160 is similar to the sleeves 42 and 76 except that, preferably, both sides of the sleeve are provided with a coating 162 disposed on an elastically coilable metal plate core or substrate part 163, see FIG. 12 also. The coating 162 may be a soft metal, such as lead, a thermite material or a pressure activated adhesive, for example. If the coating 162 is a soft metal, it will aid in providing a fluid tight seal between the sleeve 160 and the perforation 20 and will also be of some aid in providing a fluid tight seal between the layers of the sleeve 160 and between the outer layer of the sleeve and the casing wall 19. The soft metal coating 162 will also easily deform and tend to fill any creases or indentations in the sleeve coils or layers. If the coating 162 is an adhesive, it may be applied to the substrate 163 with sufficient thickness to perform the above-mentioned sealing function and it will also aid in maintaining the sleeve in a deployed position in forcible engagement with the casing 18. If the coating 162 is a thermite material, it may be applied to the substrate 163 in a sufficient quantity to effectively weld the layers of the sleeve 160 together and to the casing wall 19, when energized. The thermite material is, for example, comprised of inert metal powders such as aluminum and iron and is a material well known to those skilled in the art. The thermite material may be energized by the explosive charge or by other means causing a chemical reaction and generating enough heat to weld the sleeve layers to each other and to the casing wall 19. In such a configuration, the initiation of the explosive charge material, such as Mild Detonating Fuse, to hydroform the sleeve into the casing perforations or opening, is not necessary because the thermite weld provides an adequate seal between the sleeve and the casing or conduit opening or perforations, provided that the sleeve has been securely set in place against the casing or conduit wall. Use of the Mild Detonating Fuse material and a thermite coating applied to a sleeve is such that the resulting shock caused by the Mild Detonating Fuse material will energize the thermite material which welds the sleeve as it is being forced into closure of the casing or conduit openings or perforations. In this configuration, the Mild Detonating Fuse charge material functions to deform the sleeve into the perforations or openings and also to initiate the thermite welding of the sleeve layers together and to the conduit wall.

The types of adhesive that may be employed should comprise, for example, characteristics of being capable of remaining an adhesive in a wide and varying range of temperatures and pressures. For example, the adhesive must be capable of withstanding at least a pressure of 10,000 psi directed from the innermost layer to the outermost layer of the sleeve and be capable of withstanding a pressure of at least 3600 psi directed from the outermost layer to the innermost layer of the sleeve. The adhesive should also be impervious to saltwater or brine, capable of forming an adhesive bond in an oily environment and capable of forming an adhesive bond in a short period of time (milliseconds). Such adhesives may be selected from a group consisting of epoxies, polyurethanes, polysulfides, fluorosilicones, polychloroprene rubbers, butadiene rubbers and combinations thereof.

Figure 13:
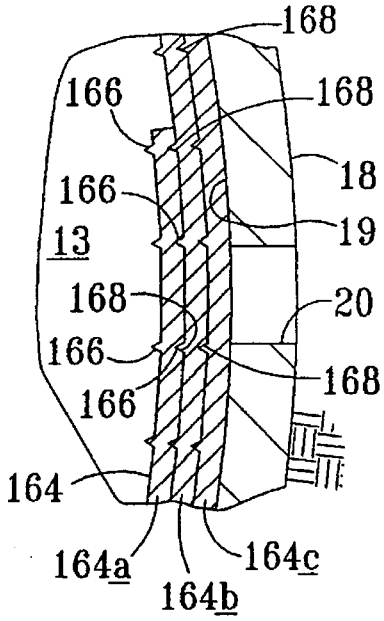
FIG. 13 is a detail transverse section view showing a portion of a third alternate embodiment of a sleeve.
Figure 14:
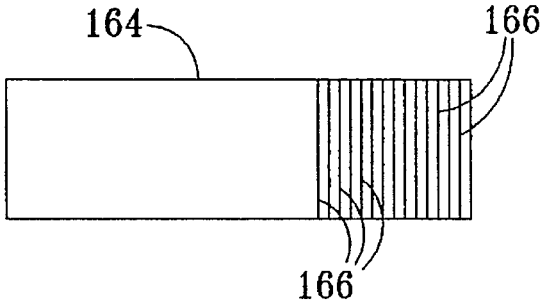
FIG. 14 is an uncoiled plan view of the sleeve shown in FIG. 13.

Referring now to FIGS. 13 and 14, a third alternate embodiment of a coilable type perforation blocking sleeve is illustrated and generally designated by the numeral 164. The sleeve 164 may be similar to the sleeve 42 or 160 in other respects but also has plural spaced apart projections 166 and corresponding recesses or indentations 168 formed over at least a portion of the sleeve so that when the multiple layers 164*a* and 164*b*, for example, overlap the projections 166 will engage the indentations 168 of the adjacent layer to aid in locking the sleeve in its deployed position. As the sleeve 164 radially expands and the layers 164*a*, 164*b*, and so on, slide over one another, the projections 166 are not of sufficient height to prevent this action, but once the sleeve has been partially uncoiled into its working position, it is highly likely that at least some of the projections 166 will nest in corresponding indentations 168 to essentially lock the sleeve in its working position.

As shown in FIG. 14, the projections 166 preferably extend over slightly less than half of the uncoiled length of the sleeve 164. In this way when the sleeve is coiled in its working position shown in FIG. 13, an outer layer 164*c* of the sleeve which is in engagement with the casing wall 19 will not have the indentations 168 formed therein and which could form a leakage path from one of the perforations 20 into the wellbore 13. The projections 166 and corresponding indentations 168 may be formed on the sleeve by a suitable coining operation, for example.

Figure 15:
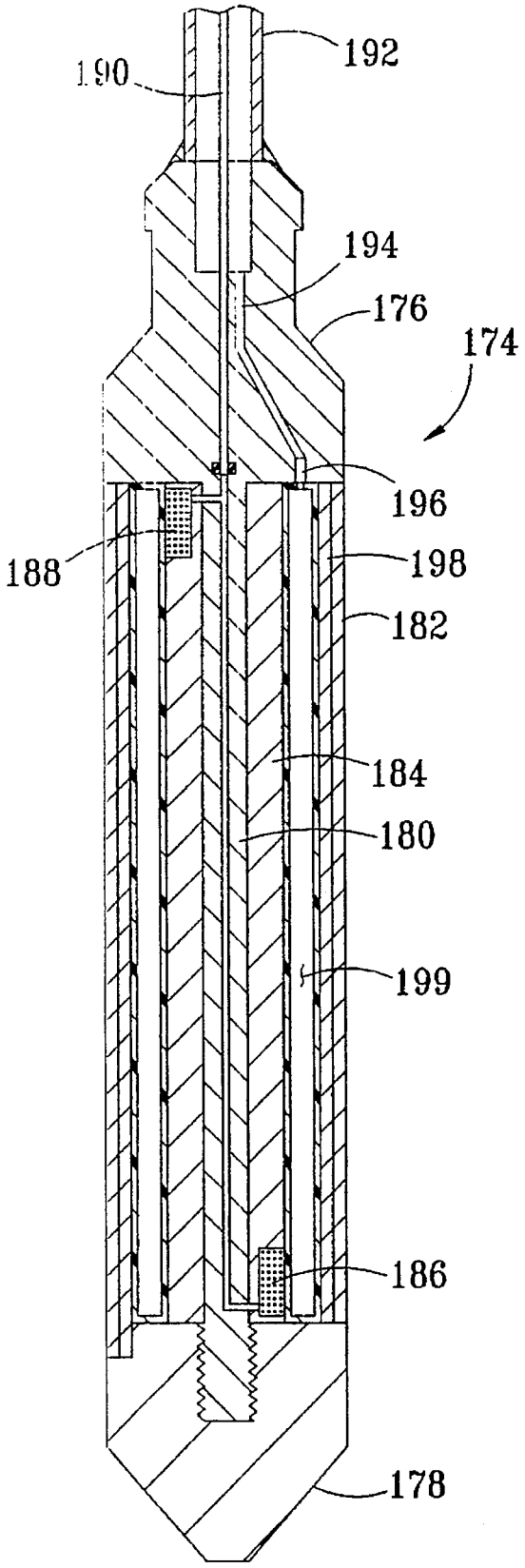
FIG. 15 is a longitudinal section view of a third alternate embodiment of an apparatus in accordance with the invention.

Referring now to FIG. 15, there is illustrated a third alternate embodiment of an apparatus for deploying an expansible sleeve in accordance with the invention and generally designated by the numeral 174. The apparatus 174 includes spaced apart head portions 176 and 178, similar in some respects to the head portions of the apparatus 34 and interconnected by a center column member 180. A radially expansible sleeve 182 is disposed on the apparatus 174 between the head portions 174 and 178. The sleeve 182 may be similar to the sleeve 42 or the sleeve 76, for example. A quantity of explosive charge material 184 is disposed between the sleeve 182 and the center column member 180 and is adapted to be energized by spaced apart igniters 186 and 188 which, respectively, are adapted to be in communication with an electrical conductor 190. The conductor 190 extends through the head 176 and within an elongated tubing 192 which may comprise conventional coilable tubing adapted to be reeled onto and off of a suitable tubing reel in a known manner. The tubing 192 with the conductor 190 disposed therein may be similar to that described in U.S. Pat. No. 4,685,516 to Smith et al. and assigned to Atlantic Richfield Company. Operation of the apparatus 174 in conjunction with the tubing deployment and retrieval apparatus described in the Smith et al. patent is believed to be within the purview of one skilled in the art.

Pressure fluid may be conducted through the tubing 192 to the head 176 and through a suitable passage 194 formed in the head and in communication with a suitable fitting 196 connected to an elastically distendable annular bladder member 198 disposed between the heads 176 and 178 and between the sleeve 182 and the charge material 184. The bladder member 198 defines an annular chamber 199 into which pressure fluid may be conducted through the fitting 196. Pressure fluid may be conducted through the tubing 192 to cause the bladder member 198 to radially distend and force the sleeve 182 radially outwardly into engagement with the inner wall of a casing or tubing, not shown in FIG. 15, prior to detonation of the charge material 184. In this way, a sleeve such as the sleeve 182 may be deployed into engagement with the casing or conduit wall prior to detonation of the explosive charge in wellbores wherein, for example, a large quantity of liquid is present in the vicinity of deployment of the sleeve and cannot be evacuated from the well.

Moreover, in certain situations wherein the well is not filled with a quantity of liquid in the vicinity of deployment of the sleeve 182, it may still be advantageous to deploy the sleeve into engagement with the casing or conduit wall prior to ignition of the explosive charge to cause the sleeve to undergo the forcible deformation or welding to the casing as described hereinabove. The apparatus 174 may be particularly useful in deploying a sleeve similar to the sleeve 76 having the longitudinal flutes or folds so that the sleeve may be deformed into a generally cylindrical configuration in engagement with the casing or conduit wall prior to ignition of the charge material. Once the sleeve has been deployed into engagement with the casing or conduit, the bladder member 198 may be deflated or inflated to rupture to minimize its absorption of the energy of the charge material 184.

The operation of the embodiments of the invention described above in conjunction with FIGS. 1 through 15 is believed to be understandable to those of skill in the art from the foregoing description of the features of the various embodiments and the manner in which the respective sleeve members may be deployed. In some instances a full circumferential "sleeve" member may not be required if a coilable or bendable plate of sufficient circumferential "width" can be properly oriented to cover any opening in the casing or conduit sidewall. Such a plate may be deployed into its working position by apparatus generally of the types described above. The high energy charge material used in the apparatus described herein may be one of a type commercially available for use in so-called explosive metal forming techniques and the associated igniter devices may be conventional explosive igniter elements or detonators. The apparatus 34, 96, 128 and 174 may be constructed using conventional engineering materials for wellbore devices, suitably reinforced or modified as described herein and to be subjected to the detonation of the explosive charges and to survive such activity in sufficient manner to be retrievable from a working position in a well casing or tubing string. The various embodiments of the apparatus may be traversed into and out of a well using conventional techniques including those described above.

Although preferred embodiments of apparatus and methods for sealing perforations and other openings in conduits, well casings and liners have been described in detail herein, those skilled in the art will recognize that various substitutions and modifications may be made to the embodiments described without departing from the scope and spirit of the appended claims.

What is claimed is:

1. Apparatus for sealing an opening in a well conduit to form a substantially fluid tight seal at said opening, said apparatus comprising:

a radially expansible sleeve expandable to be forcibly engaged with an interior wall surface of said conduit to close an opening in said conduit, said sleeve comprising a radially expansible coiled metal member forming at least one complete wrap in a deployed position in forcible engagement with said conduit, said sleeve being radially contractible to be disposed on said body;

a body supporting said sleeve for traversal into a well to a position generally adjacent said opening in said conduit and disposed within said conduit;

a quantity of an explosive charge material disposed on said body and operable to explosively expand said sleeve into forcible and fluid tight sealing engagement with said conduit; and a detonator operatively connected to said charge material to initiate an explosion of said charge material to expand said sleeve into forcible and substantially fluid tight sealing engagement with said conduit to form a substantially fluid tight seal of said opening.

2. The apparatus set forth in claim 1 wherein:

said sleeve includes means forming cooperating projections and indentations which are operable to engage one another in a deployed position of said sleeve to hold said sleeve in its deployed position.

3. The apparatus set forth in claim 1 including:

means for retaining said sleeve in a radially contracted condition on said apparatus.

4. The apparatus set forth in claim 3 wherein:

said means for retaining said sleeve in said radially contracted condition comprises at least one band disposed around said sleeve on said apparatus; and means for severing said band to allow movement of said sleeve from said radially contracted condition to a radially expanded condition in engagement with said conduit.

5. The apparatus set forth in claim 3 wherein:

said means for retaining said sleeve in said radially contracted condition comprises a cylinder forming a part of said body and for containing at least a part of said sleeve.

6. The apparatus set forth in claim 5 including:

piston means disposed on said body and responsive to pressure fluid acting thereon for displacing said sleeve from said cylinder.

7. The apparatus set forth in claim 6 wherein:

said body is deployable into said conduit by a tubing string, said tubing string including a conductor disposed therein and connected to said detonator disposed on said body for igniting said charge material to deform said sleeve into forcible engagement with said conduit.

8. Apparatus for sealing an opening in a well conduit to form a substantially fluid tight seal at said opening, said apparatus comprising:

a radially expansible sleeve expandable to be forcibly engaged with an interior wall surface of said conduit to close an opening in said conduit said sleeve comprising a cylindrical tube having a plurality of elongated axially extending flutes formed by external and internal folds;

a body supporting said sleeve for traversal into a well to a position generally adjacent said opening in said conduit and disposed within said conduit;

a quantity of an explosive charge material disposed on said body and operable to explosively expand said sleeve into forcible and fluid tight sealing engagement with said conduit; and a detonator operatively connected to said charge material to initiate an explosion of said charge material to expand into forcible and substantially fluid tight sealing engagement with said conduit to form a substantially fluid tight seal at said opening.

9. Apparatus for sealing an opening in a well conduit to form a substantially fluid tight seal at said opening, said apparatus comprising:

a radially expansible sleeve expandable to be forcibly engaged with an interior wall surface of said conduit to close an opening in said conduit;

a body supporting said sleeve for traversal into a well to a position generally adjacent said opening in said conduit and disposed within said conduit;

a quantity of an explosive charge material disposed on said body and operable to explosively expand said sleeve into forcible and fluid tight sealing engagement with said conduit;

a detonator operatively connected to said charge material to initiate an explosion of said charge material to expand said sleeve into forcible and substantially fluid tight sealing engagement with said conduit to form a substantially fluid tight seal at said opening, and a connector connecting the apparatus to an elongated member for deploying the apparatus in a well, the elongated member comprising a cable including electrical conductor means associated therewith for transmitting an energizing signal to said charge material.

10. The apparatus set forth in claim 9, wherein:

said elongated member comprises a tube connected to said apparatus and to a source of pressure fluid and electrical conductor means associated with said tube for transmitting an energizing signal to said charge material.

11. The apparatus set forth in claim 9, including:

elastically distendable bladder means disposed on said apparatus and operably engageable with said sleeve for effecting radial expansion of said sleeve toward engagement with said conduit in response to pressure fluid acting on said bladder means.

12. Apparatus for sealing an opening in a well conduit to form a substantially fluid tight seal at said opening, said apparatus comprising:

a radially expansible sleeve expandable to be forcibly engaged with an interior wall surface of said conduit to close an opening in said conduit;

a body supporting said sleeve for traversal into a well to a position generally adjacent said opening in said conduit and disposed within said conduit;

a quantity of an explosive charge material disposed on said body and operable to explosively expand said sleeve into forcible and fluid tight sealing engagement with said conduit; and a detonator operatively connected to said charge material to initiate an explosion of said charge material to expand said sleeve into forcible and substantially fluid tight sealing engagement with said conduit to form a substantially fluid tight seal at said opening; and a flexible cable connected to the sleeve and to the apparatus and operable to allow the sleeve to be deployed from a radially contracted position on the apparatus to a radially expanded position toward engagement with said conduit.

13. A method for closing an opening in a well conduit to substantially prevent fluid flow through said opening, comprising the steps of:

placing an elongated sleeve in said conduit adjacent said opening; and moving said sleeve from a radially contracted position out of engagement with the conduit into a radially expanded position in forcible engagement with the conduit, detonating an explosive charge positioned to expand said sleeve into forcible and substantially fluid tight sealing engagement with said conduit to close said opening.

14. The method set forth in claim 13 including the step of:

providing means responsive to pressure fluid acting thereon for expanding said sleeve into engagement with said conduit.

15. The method set forth in claim 13 including the step of:

providing said sleeve as a coiled plate number and causing said sleeve to at least partially uncoil to move into forcible engagement with said conduit.

16. The method set forth in claim 15 including the step of:

providing said sleeve with a coating to effect a substantially fluid tight seal between said sleeve and said conduit and between said coils of said sleeve.

17. The method set forth in claim 15 including the step of:

providing said sleeve with plural spaced apart projection means operable to hold said sleeve at least partially uncoiled in forcible engagement with said conduit.

18. A method for closing an opening in a conduit comprising the steps of:

placing a sleeve in said conduit adjacent said opening the sleeve consisting of a coiled metal sheet or plate member at least partially coiled to have an outside diameter less than the inside diameter of said conduit;

moving the sleeve from a radially contracted position out of engagement with said conduit into a radially expanded position in forcible engagement with said conduit; and, energizing an explosive charge to urge said sleeve into forcible and substantially fluid tight sealing engagement with said conduit to substantially close said opening.

19. The method set forth in claim 18 including the step of:

placing said explosive charge within said sleeve in its at least partially coiled condition before energizing said explosive charge.

20. The method set forth in claim 18 including the step of:

radially expanding said sleeve into engagement with said conduit before energizing said explosive charge.

21. The method set forth in claim 19 wherein:

said sleeve is placed in said conduit disposed on apparatus connected to a source of pressure fluid and said sleeve is forcibly deployed under the urging of pressure fluid forces into engagement with said conduit.

22. The method set forth in claim 18 including the steps of:

providing said sleeve as a generally tubular member having plural flutes formed by external and internal folds in said sleeve;

placing said explosive charge within said tubular member; and energizing said explosive charge to cause said sleeve to radially expand said flutes into forcible engagement with said conduit.

23. A method for closing an opening in a well conduit to substantially prevent fluid flow between said conduit and an earth formation surrounding said conduit, comprising the steps of:

placing an elongated sleeve in said conduit adjacent said opening;

displacing liquid from a space between said sleeve and said conduit;

moving said sleeve from a radially contracted position to a radially expanded position to engage said conduit after displacement of said liquid and prior to detonating said explosive charge; and, detonating an explosive charge to urge said sleeve into forcible and substantially fluid tight sealing engagement with said conduit to close said opening.

* * * * *